US007946090B1

(12) United States Patent
Walters et al.

(10) Patent No.: US 7,946,090 B1
(45) Date of Patent: May 24, 2011

(54) CONCRETE WALL AND FORMING SYSTEM THEREFORE

(76) Inventors: Herbert E. Walters, Eureka, MO (US); Cheryl Ann Walters, Eureka, MO (US)

( * ) Notice: Subject to any disclaimer, the term of this patent is extended or adjusted under 35 U.S.C. 154(b) by 250 days.

(21) Appl. No.: 11/893,913

(22) Filed: Aug. 17, 2007

(51) Int. Cl.
*E04B 2/08* (2006.01)

(52) U.S. Cl. ..... 52/592.6; 52/309.17; 52/309.12; 52/309.8; 52/309.7; 52/601; 52/604; 52/605; 52/592.5; 52/574

(58) Field of Classification Search ..... 52/309.4, 52/309.8, 309.11, 309.12, 309.15, 309.16, 52/309.17, 503–505, 578, 592.3, 592.4–592.5, 52/592.6, 596–612, 574, 309.2, 309.7, 309.9, 52/578.601, 581
See application file for complete search history.

(56) References Cited

U.S. PATENT DOCUMENTS

| | | | | | |
|---|---|---|---|---|---|
| 3,401,494 | A * | 9/1968 | Anderson | 52/309.2 |
| 3,534,518 | A * | 10/1970 | Zagray | 52/258 |
| 3,715,417 | A * | 2/1973 | Panousis et al. | 264/46.5 |
| 4,653,246 | A * | 3/1987 | Hepler | 52/787.11 |
| 4,942,707 | A * | 7/1990 | Huettemann | 52/259 |
| 5,664,382 | A * | 9/1997 | Melnick et al. | 52/425 |
| 5,673,529 | A * | 10/1997 | Treister et al. | 52/511 |
| 5,758,464 | A * | 6/1998 | Hatton | 52/404.1 |
| 6,067,765 | A * | 5/2000 | Jones | 52/309.12 |
| 6,098,357 | A * | 8/2000 | Franklin et al. | 52/223.7 |
| 6,725,616 | B1 * | 4/2004 | Pease | 52/309.7 |
| 7,059,577 | B1 * | 6/2006 | Burgett | 249/40 |
| 2001/0002528 | A1 * | 6/2001 | Fust, III | 52/422 |
| 2003/0170093 | A1 * | 9/2003 | Janeway | 411/548 |

* cited by examiner

*Primary Examiner* — Jeanette E. Chapman

(57) ABSTRACT

A system of making self-aligning concrete block structures. Structure is made of interlinking blocks that have insulative foam that is affixed during the molding process. The interior surface of the blocks is specifically designed to avoid the use of interior framing by providing wooden strips such that drywall can be directly affixed. The concrete block system include top blocks, inside and outside corner blocks, and the necessary forms for their construction.

26 Claims, 8 Drawing Sheets

Figure 21:
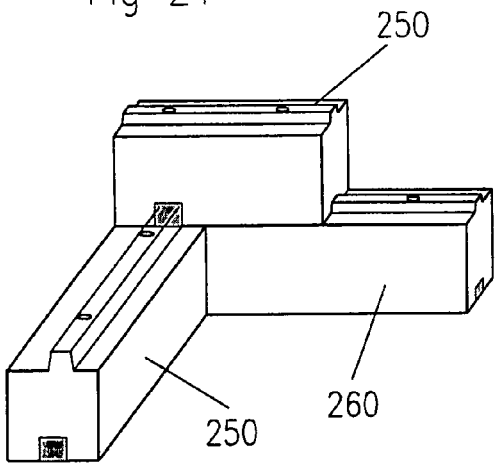

Fig 1
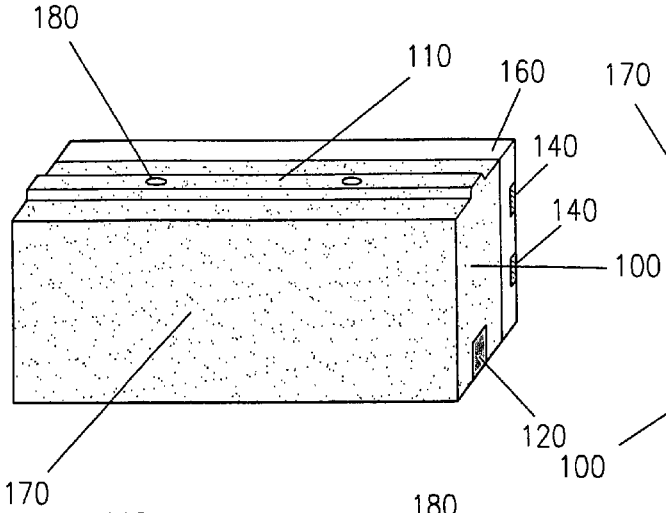
Fig 2
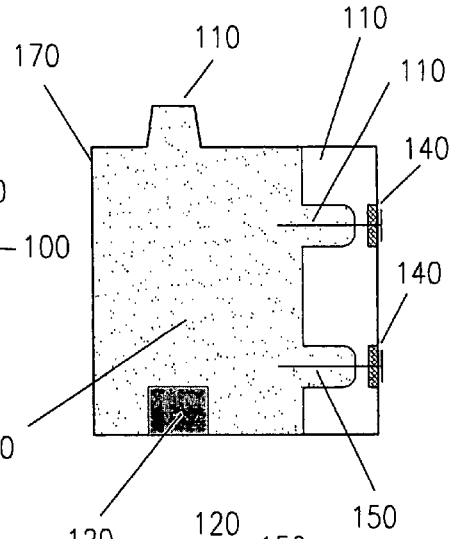
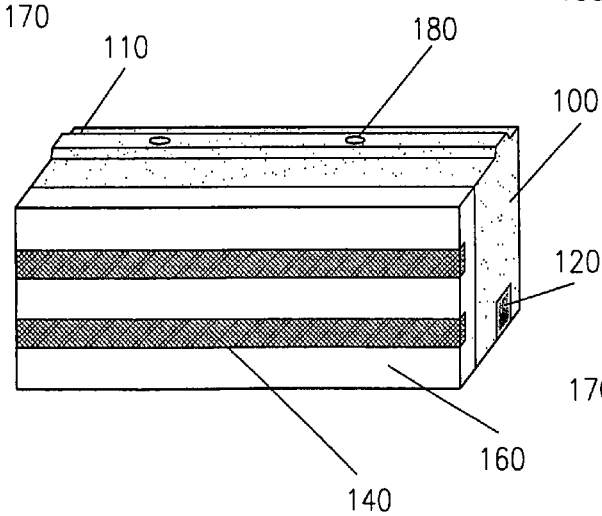
Fig 3
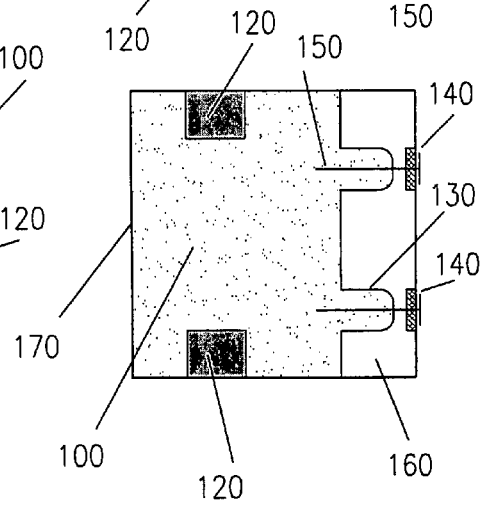
Fig 4

Fig 5
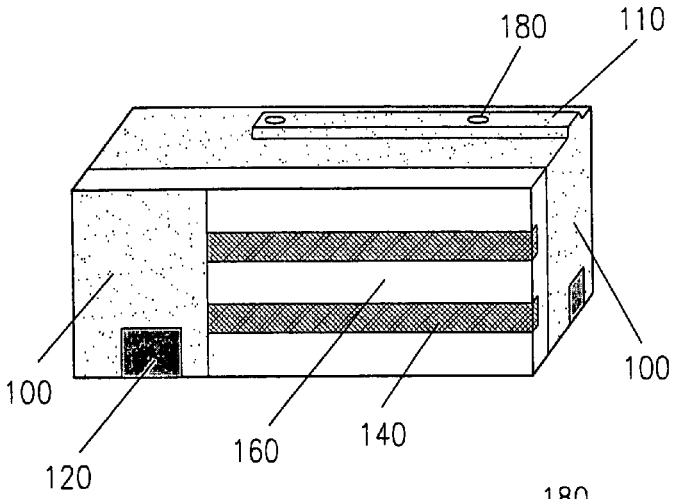
Fig 6
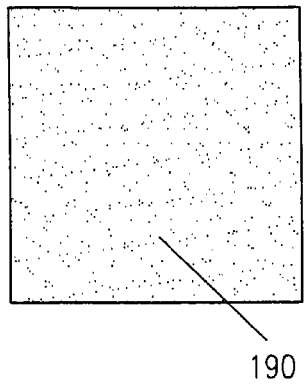
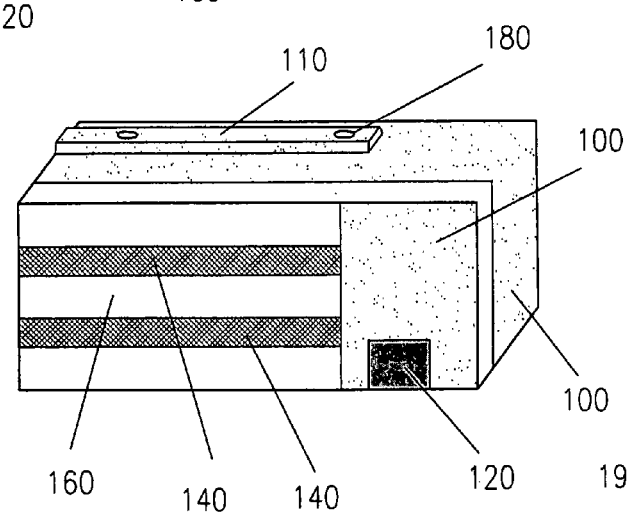
Fig 7
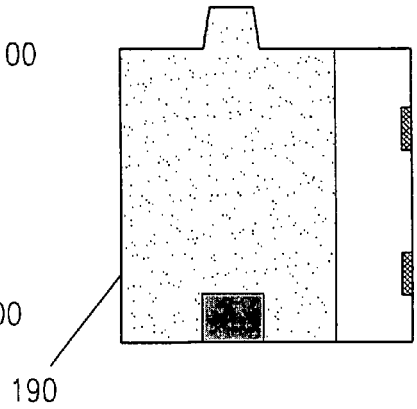
Fig 8

Fig 9
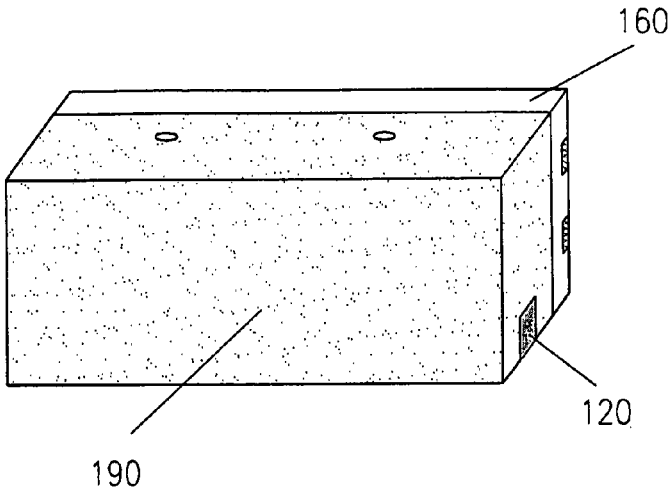
Fig 10
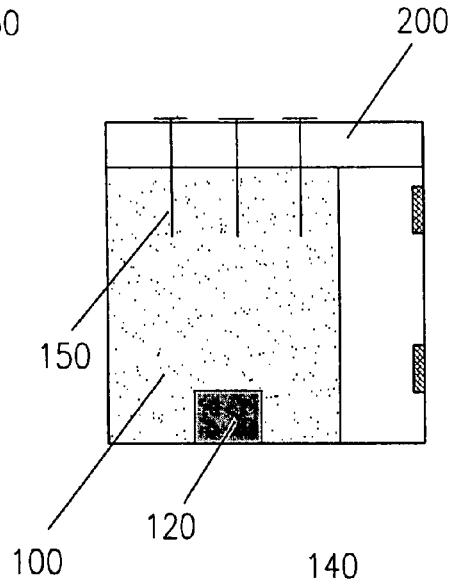
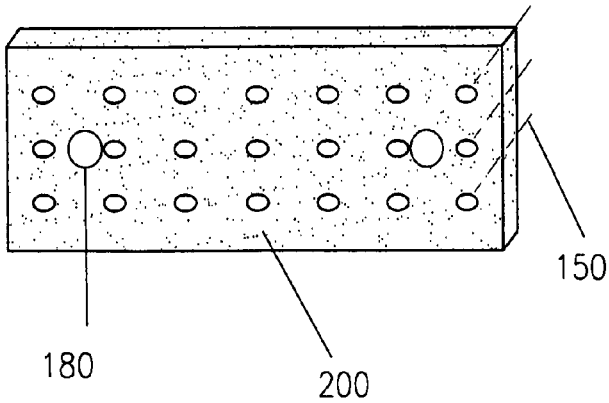
Fig 11
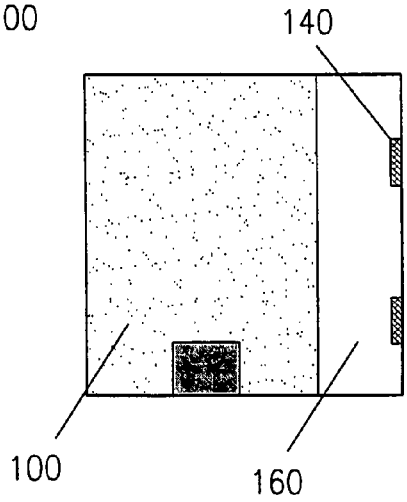
Fig 12

Fig 13
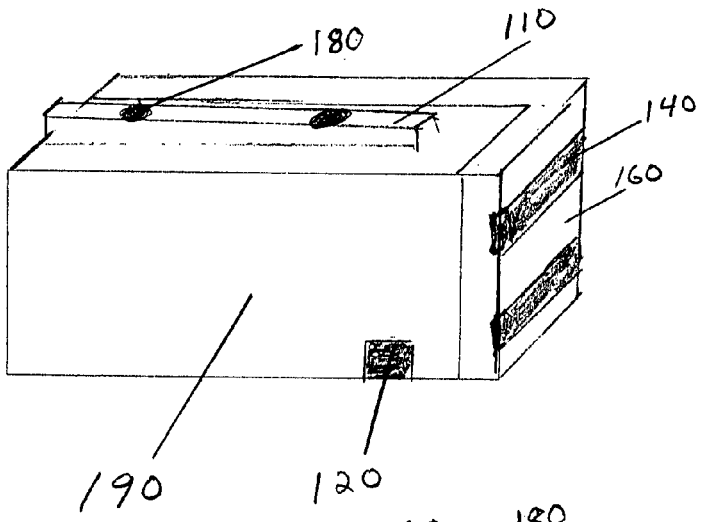
Fig 14
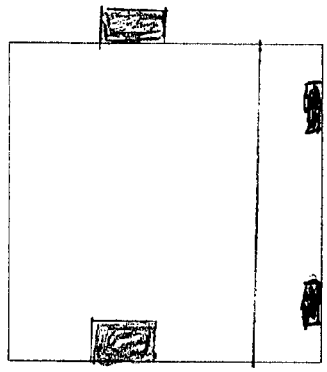
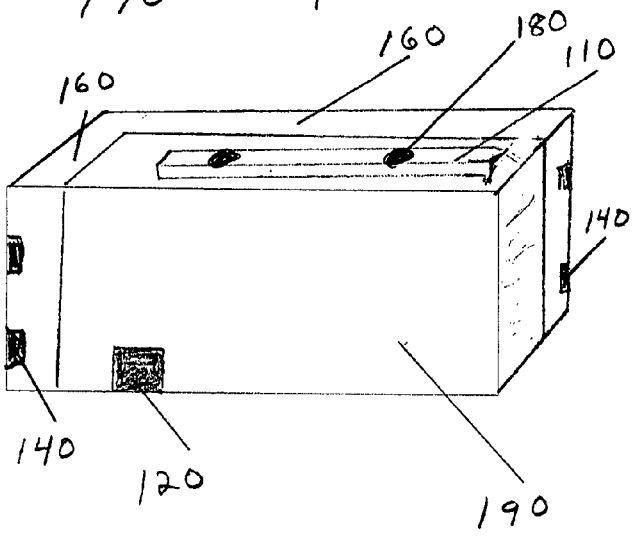
Fig 15
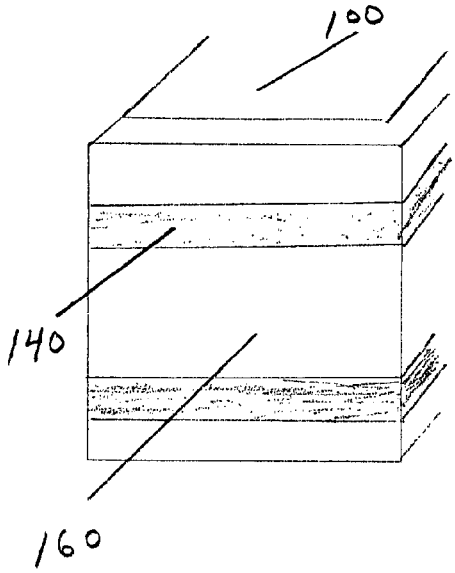
Fig 16

Fig 17
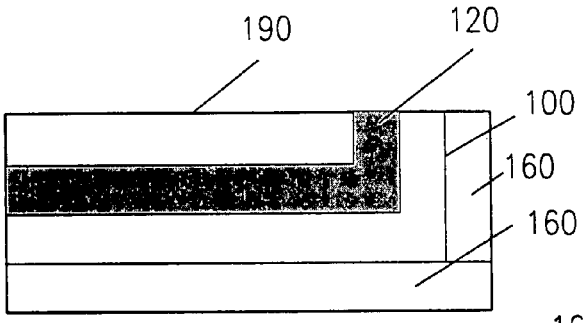
Fig 18
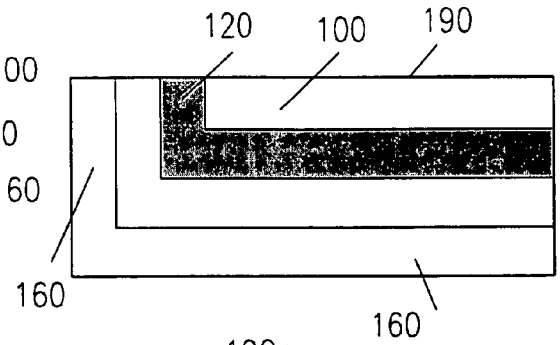
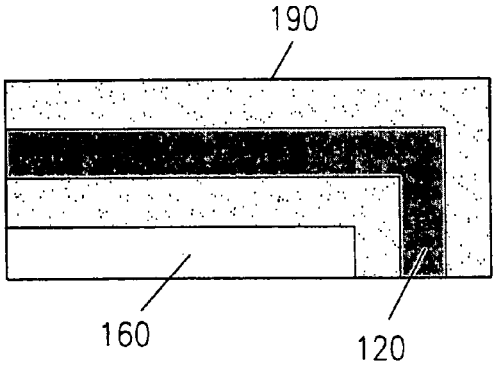
Fig 19
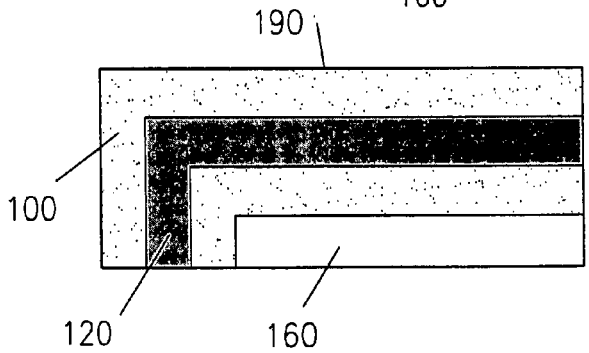
Fig 20

Fig 26
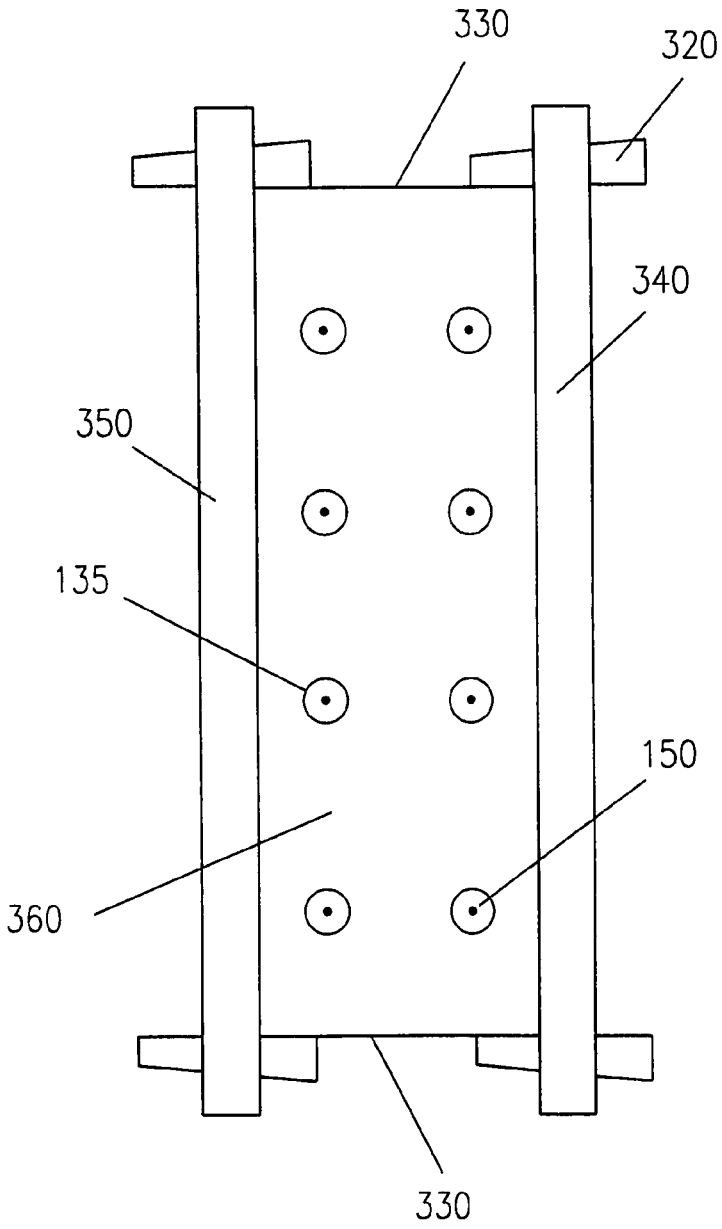
Fig 27
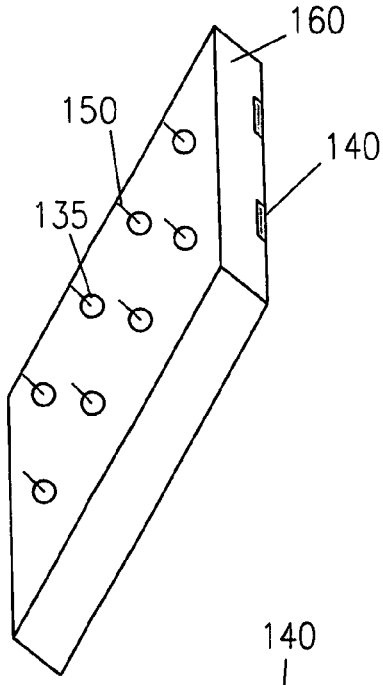
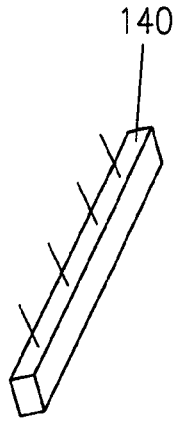
Fig 28

CONCRETE WALL AND FORMING SYSTEM THEREFORE

BACKGROUND OF THE INVENTION

1. Field of Invention

The present invention relates to a self-aligning concrete building block that incorporates insulation and nail strips onto a face of the block, forms for making the blocks, and building structures formed with the blocks.

2. Background of the Invention

Various concrete building structures are made with concrete blocks. When constructing the walls of these structures each individual block must be manually aligned with a level and square. Traditional blocks are filled with grout and joints are finished with mortar. This method of construction is susceptible to shear and uplift forces.

When the walls of traditional concrete blocks and grout are made it is common to frame the inside with a wood or steel structure. This framing is then filled with insulation and further provides a surface to attach drywall. This process of wall construction involves many steps and is very labor intensive.

Traditional concrete blocks are also designed to be easily handled and stacked by one person. With modern industrial construction equipment it would be more efficient to have larger blocks that would be machine stacked. In addition, prior concrete block structures suffer from one or more of the following problems or disadvantages: (1) in need of manual alignment, (2) susceptible to shear and uplift forces, (3) require that interior framing walls be built, (4) lack insulation, (5) require many steps, (6) are very labor intensive, and (7) are not designed with modern construction machinery in mind.

Examples of prior concrete block systems include U.S. Pat. No. 0,010,827 to Vanhoutte (2006); U.S. Pat. No. 0,257,481 (2005) to Shaw; U.S. Pat. No. 0,223,669 (2005) to Cymbala; U.S. Pat. No. 6,829,867 (2004) to Gresser; U.S. Pat. No. 6,665,994 to Ruggeri; U.S. Pat. No. 5,350,256 (1994) to Hammer.

Each of these systems suffers from one or more of the previously described problems or disadvantages.

OBJECTIVES AND ADVANTAGES

Accordingly, inventors created a concrete block and method of building structures that would be more efficient, durable, and:

(a) to providing a tongue and groove structure that interlinks and is self-aligning;

(b) to provide affixed insulation;

(c) to provide a surface that would directly attach to drywall;

(d) to provide a more study and long-lasting system;

(e) to provide a system that required less labor and a sequence of fewer steps;

(f) to provide a design more fitting for modern construction equipment.

(g) to proved a structure that could be erected with minimal time.

Further objectives and advantages are to provide forms for molding such concrete blocks that are reusable and can be easily be assembled and disabled. This would allow for the possibility of manufacturing said blocks on a job site thereby saving transportation costs.

SUMMARY

In accordance with the invention, a concrete building block has tongue and grove structure that provide for said blocks to stack one upon another in an interlinking fashion that self-aligns. A layer of insulating foam is affixed that has two wood strips received in recesses formed in an outer surface of the foam and the layer of foam further has a plurality of cylindrical cavities in alignment with the wood strips formed in an inner surface of the foam. The wood strips are attached to the insulative foam by fasteners having an upper end extending into the cylindrical cavities when the concrete block is formed.

A form is provided for molding the building blocks as described above. The form has side walls which create the tongue on the top of the block and a groove on the bottom. Further, the form has two pipe like cylindrical tubes that extend from side-to-side. When the concrete has set and the forms are dissembled the pipe like cylindrical tubes are removed providing two holes for the placement of reinforcing steel.

A building structure may be constructed by stacking the aforementioned blocks. Accordingly, the blocks are arranged with the layer of insulative foam facing an interior of the structure whereby the interior of the structure may be finished with drywall or paneling fastened to the wooden strips with fasteners.

DRAWINGS

Figures

Figure 22:
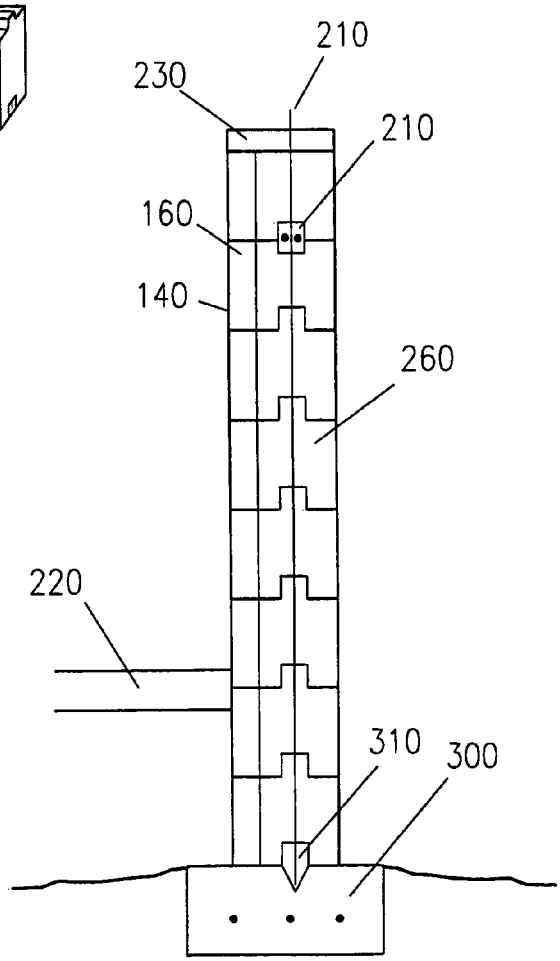
Figure 23:
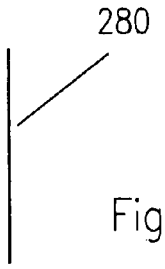
Figure 24:
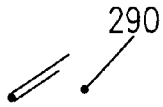
Figure 25:
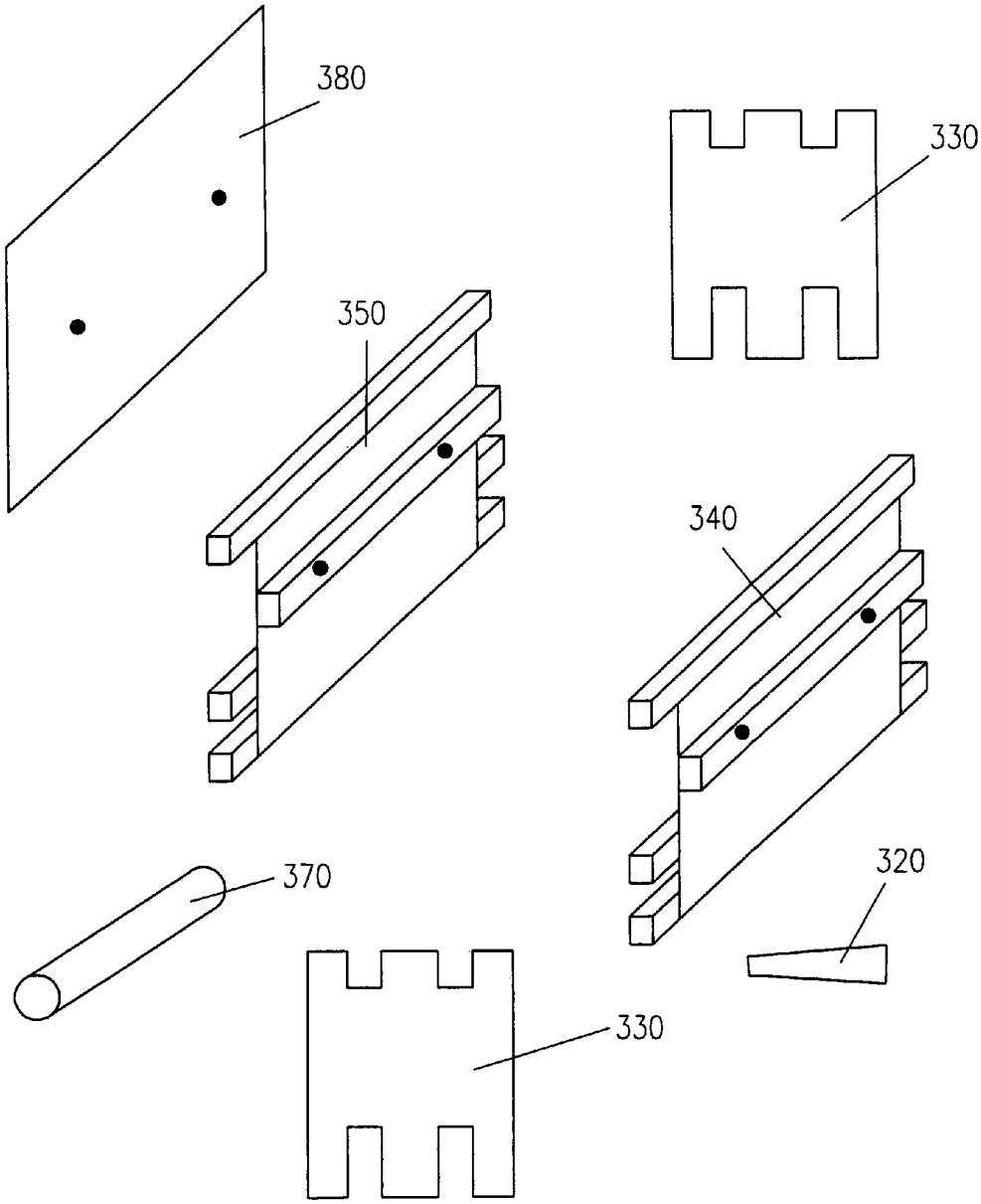

FIG. 1 shows the exterior side of concrete block.
FIG. 2 shows the end side of concrete block
FIG. 3 shows interior surface of block
FIG. 4 shows a double groove block
FIG. 5 shows a inside right corner block
FIG. 6 shows a end view of a corner block
FIG. 7 shows a inside left corner block
FIG. 8 shows the opposite end of FIG. 6*n*
FIG. 9 shows a top block without a top plate
FIG. 10 shows a top block with wood or steel top plate
FIG. 11 shows wood or steel top plate with fastener molded in concrete for top plate
FIG. 12 shows end of top block with bolt down top plate
FIG. 13 shows a outside right corner block
FIG. 14 shows end view of right outside corner block
FIG. 15 shows left outside corner block
FIG. 16 shows end view of outside corner block
FIG. 17 shows bottom view of outside corner block
FIG. 18 shows bottom view of left outside corner block
FIG. 19 shows bottom view of right outside corner block
FIG. 20 shows bottom view of left outside corner
FIG. 21 shows outside view of corner assembly
FIG. 22 shows vertical assembly of block structure
FIG. 23 shows vertical rebar
FIG. 24 shows horizontal rebar
FIG. 25 shows dissembled form
FIG. 26 shows top view of assembled form
FIG. 27 shows foam panel
FIG. 28 shows wood strips

DRAWINGS

Reference Numerals

100 concrete
110 concrete tongue
120 concrete groove
130 concrete knobs
135 concrete cavities

140 wood strip
150 fastners
160 insulative foam
170 concrete finish exterior
180 rebar holes
190 outside of wall
200 molded steel or wood
210 rebar
220 concrete floor
230 top plate
240 right corner
250 left corner
260 straight block
270 double grove block
280 vertical rebar steel
290 horizontal rebar steel
300 footing
310 footing keyway
320 form key
330 end plate
340 slotted tabs and panels tongue
350 slotted tabs and panels groove
360 foam in bottom of form
370 pipe to create hole for rebar
380 flat insert panel for top blocks

DETAILED DESCRIPTION OF THE PREFERRED EMBODIMENT

FIGS. 1-4 displays the concrete block from various views. Insulative foam 160 is attached to the inside of the block by means of two wood strips 140 that run parallel across the face. The top of the block has a tongue 110 and the bottom a groove 120 that run the length of the block. The block has two holes 180 that run vertically from the top tongue to the bottom grove for the insertion of reinforcing steel.

FIGS. 13-16 displays concrete block that are used for outside corners. These corner blocks have a tongue 110 and corresponding grove, but they do not run the entire length of the block. Rather, the tongue and grove stop short where the actual bend occurs. On the bottom of the block FIGS. 17-20 short groove 120 meets at a 90 degree angle with the groove that runs lengthwise, forming an outside corner. The foam 160 and wood strips 140 cover the interior face.

The corner blocks in FIGS. 13-16 are used for making inside corners. These blocks differ from the outside corner blocks in that they have foam 160 and wood strips 140 that cover two faces. The inside corner blocks both have the tongue 110 and groove 120 structure. The inside corner blocks have two holes 180 for steel reinforcement.

FIGS. 9-10 shows the top block that are used on the top row when building a wall. These blocks do not have the top tongue, but do have a bottom groove 120. The top blocks have a top plate 200 fastened to to the concrete during the molding process. Nails or fasteners 150 are used to secure the top plate to the concrete block. The top block has two holes 180 for steel reinforcement.

A corner assembly FIG. 21 is made with 250 as corner block and 260 as a straight block.

A vertical wall assembly FIG. 22 is constructed with straight blocks with a steel reinforcement rod traveling the entire height. The foam 160 and wooden strips 140 are on the interior side and the top block has a top plate 230. The wall is secured by a footing 300 and a 310 footing key way.

DETAILED DESCRIPTION

Manufacturing of Blocks

A piece of foam FIG. 27 has two recessed grooves at even distance apart on the interior surface where drywall may be affixed. Spacing is determined by the building codes for drywall nail distance. The recessed grooves may be routed or hot wire cut. The depth of grooves depends on thickness of nailer 140. The opposite side of foam is drilled with a large bit to a depth that comes within ½ inch of the recessed groove to provide a barrier for condensation.

Fasteners longer than thickness of foam are drove through the nailer 140 and nailer with fasteners are pushed through the side of foam that has been grooved such that the fasteners are in the center of the holes and nailer 140 is recessed into foam. The foam and nailer are now placed into the molding form.

Form FIG. 25 has two end plates 330 and one grooved producing panel 350, one tongue protruding panel 340 and two tubes or pipes 370 which produce rebar holes 180. Eight wedges or form keys 320 fit into slots cut at the end of panels 340 350 to fasten mold together.

As concrete is poured into the form FIG. 26 it will fill around fasteners 150 and form concrete knobs 130. Before the concrete has hardened, the exterior surface may be textured for later application of stucco, stain, or rock. When the concrete hardens the foam and wood nailer are permanently affixed to the block forming a single solid unit.

For longer blocks as may be used over garage doors or door ways it is possible to join two slotted tongue panels 340 and two slotted groove panels 350 together to form a longer mold.

If a top block is needed, a panel FIG. 25 380 will fit into there form to prevent the forming of a top tongue.

We claim:

1. A concrete wall portion comprising:

a concrete body having an interior surface and an exterior surface;

an insulation sheet extending along the interior surface of the concrete body, the insulation sheet having a cavity; and a nailer strip extending along the insulation sheet, the nailer strip having a fastener connected thereto extending into the concrete body through the interior surface, the fastener extending into the cavity, wherein the concrete body surrounds, and is affixed to, the fastener when the concrete body is formed, the concrete body being formed in the cavity around the fastener.

2. The concrete wall portion of claim 1, wherein the insulation sheet and the nailer strip are permanently affixed to the concrete body by the fastener when the concrete body is cured.

3. The concrete wall portion of claim 1, wherein the insulation sheet and the nailer strip are part of a forming system for the concrete body, wherein concrete is poured against the insulation sheet and the fastener during forming of the concrete body.

4. The concrete wall portion of claim 1, wherein the insulation sheet includes an inner surface and an outer surface, the interior surface of the concrete body being formed against the outer surface of the insulation sheet, the fastener extending outward from the insulation sheet into the concrete body.

5. The concrete wall portion of claim 1, wherein the concrete body is formed from poured concrete poured against the insulation sheet, wherein the fastener is affixed to the concrete body when the concrete body is cured.

6. The concrete wall portion of claim 1, wherein the insulation sheet includes a channel formed therein, the nailer strip being received within the channel of the insulation sheet, the fastener extending from the nailer strip through the insulation sheet at a base of the channel.

7. The concrete wall portion of claim 1, wherein the fastener holds the nailer strip relative to the concrete body, a portion of the insulation sheet being positioned between the nailer strip and the concrete body, wherein the nailer strip holds the insulation sheet relative to the concrete body via the fastener.

8. The concrete wall portion of claim 1, wherein the fastener includes a shaft and a head, the head resting against the nailer strip, the shaft extending through the nailer strip and the insulation sheet into the concrete body.

9. The concrete wall portion of claim 1, wherein the insulation sheet includes an inner surface and an outer surface, the insulation sheet having a channel being formed in the inner surface, the outer surface having a cavity formed therein aligned with the channel, the fastener extending through the insulation sheet separating the channel and cavity such that a portion of the fastener is received within the cavity, the concrete body being formed from poured concrete poured against the outer surface, the concrete filling the cavity around the fastener.

10. The concrete wall portion of claim 1, wherein the exterior surface is stamped with a texture prior to the concrete body curing.

11. The concrete wall portion of claim 1, wherein the concrete body defines a block body having a tongue and groove set for stacking with other concrete wall portions.

12. The concrete wall portion of claim 1, wherein the concrete body includes an opening therethrough configured to receive a reinforcing bar and grout therein, the grout hardening within the opening to secure the reinforcing bar within the opening.

13. The concrete wall portion of claim 1, wherein the insulation sheet includes an inner surface, an outer surface and opposed ends extending between the inner and outer surfaces, the outer surface engaging the interior surface of the concrete body, at least one of the ends of the insulation sheet engaging the concrete body.

14. The concrete wall portion of claim 1, wherein the interior surface of the concrete body and the insulation sheet have the same perimeter.

15. The concrete wall portion of claim 1, wherein the concrete body is formed into a stackable block body.

16. The concrete wall portion of claim 1, wherein the concrete body is formed into a stackable block body, the stackable block body being stackable in at least one of side-by-side configuration with another concrete wall portion or an above/below configuration with another concrete wall portion.

17. The concrete wall portion of claim 1, wherein the concrete body is formed in place against the insulation sheet.

18. A concrete wall portion comprising:

a concrete body having an interior surface and an exterior surface, wherein the interior surface of the concrete body is generally planar and includes a concrete knob extending therefrom;

an insulation sheet extending along the interior surface of the concrete body; and a nailer strip extending along the insulation sheet, the nailer strip having a fastener connected thereto extending into the concrete body through the interior surface, the fastener being positioned within the concrete knob, wherein the concrete body surrounds, and is affixed to, the fastener when the concrete body is formed.

19. The concrete wall portion of claim 18, wherein the insulation sheet includes a cavity, the fastener extending into the cavity, the concrete body being formed in the cavity around the fastener.

20. The concrete wall portion of claim 18, wherein the interior surface of the concrete body and the insulation sheet have the same perimeter.

21. The concrete wall portion of claim 18, wherein the concrete body is one of formed into a stackable block body or formed in place against the insulation sheet.

22. A concrete wall portion forming system comprising:

an insulation sheet having an inner surface and an outer surface, the insulation sheet having a channel formed therein along the inner surface;

a nailer strip received within the channel of the insulation sheet, the nailer strip having a fastener extending therefrom, wherein the nailer strip is positioned such that the fastener extends outward of the outer surface of the insulation sheet;

wherein the concrete wall portion is poured against the outer surface of the insulation sheet such that the fastener is embedded within the concrete wall portion to affix the insulation sheet to the concrete wall portion; and removable forms arranged to define a cavity into which concrete is poured to form the concrete wall portion, the insulation sheet being arranged within the cavity.

23. The concrete wall portion forming system of claim 22, wherein the insulation sheet and nailer strip are affixed to the concrete wall portion such that the removable forms are removable from the concrete wall portion, insulation sheet and nailer strip.

24. The concrete wall portion forming system of claim 22, wherein the insulation sheet includes a cavity, the fastener extending into the cavity, wherein the concrete forming the concrete wall portion fills the cavity around the fastener to affix the insulation sheet to the concrete wall portion.

25. The concrete wall portion forming system of claim 22, wherein the concrete wall portion includes an interior surface against the insulation sheet, the interior surface being generally planar and including a concrete knob extending therefrom into the insulation sheet, the fastener being embedded within the concrete knob.

26. The concrete wall portion forming system of claim 22, wherein the insulation sheet and the nailer strip are permanently affixed to the concrete wall portion by the fastener when the concrete defining the concrete wall portion is cured during a hardening process.

* * * * *